United States Patent [19]

Ogilvie et al.

[11] Patent Number: 5,014,389

[45] Date of Patent: May 14, 1991

[54] FOOT MANIPULATED SUCTION HEAD AND METHOD FOR EMPLOYING SAME

[75] Inventors: Rick A. Ogilvie, Ancaster, Canada; Rance A. Winkler, Largo, Fla.

[73] Assignee: Concept Inc., Largo, Fla.

[21] Appl. No.: 436,774

[22] Filed: Nov. 15, 1989

[51] Int. Cl.[5] ..... A47L 9/06

[52] U.S. Cl. ..... 15/353; 15/415.1; 137/602

[58] Field of Search ..... 137/602; 15/1.7, 322, 15/353, 415 R, 420

[56] References Cited

U.S. PATENT DOCUMENTS

| | | | |
|---|---|---|---|
| 2,816,664 | 12/1957 | Haynes | 15/1.7 X |
| 2,966,694 | 1/1961 | Brown | 15/420 X |
| 3,605,171 | 9/1971 | Candor et al. | 15/420 X |
| 4,041,569 | 8/1977 | Petersen | 15/353 |
| 4,156,948 | 6/1979 | Chauvier et al. | 15/1.7 |

FOREIGN PATENT DOCUMENTS

| | | | |
|---|---|---|---|
| 309158 | 11/1955 | Switzerland | 15/420 |

*Primary Examiner*—Stephen M. Hepperle
*Attorney, Agent, or Firm*—Epstein, Edell & Retzer

[57] ABSTRACT

A method and apparatus for aspirating fluids from a surgical operating room utilizing a suction head that readily slides along the floor in response to translational forces applied by foot by operating room personnel. The suction head has a flat bottom surface with a plurality of narrow flow channels defined therein between a suction port mouth and the surface periphery. Support ribs, disposed on the top surface in juxtaposed alignment with respective flow channels, impart strength to the suction head and prevent sealing of the flow channels. The suction head is adapted to operate with suction sources commonly available in surgical operating rooms operating through a fluid waste collection chamber. The flow channels conduct fluid to be aspirated while preventing the bottom surface from becoming sealed to the floor.

13 Claims, 2 Drawing Sheets

FOOT MANIPULATED SUCTION HEAD AND METHOD FOR EMPLOYING SAME

BACKGROUND OF THE INVENTION

1. Technical Field

The present invention relates to a method and apparatus for removing fluid matter that drains or spills onto the floor during a surgical procedure. More particularly, the invention relates to a disposable foot-manipulated suction head and hose attachment adapted for use with suction sources commonly available in surgical operating rooms.

2. Discussion of the Prior Art

During the course of surgery, and particularly during arthroscopic surgery, waste fluids of various types find their way to the floor of the operating room. Specifically, during arthroscopic surgery sterile fluid (e.g., saline) is supplied to the surgical site as a distension medium for the joint. This fluid, if permitted to drain uncontrolled to the floor, presents a safety hazard in that operating room personnel are likely to slip and fall. The possible contamination of the fluid presents an additional hazard.

A prior art approach toward solving this problem is disclosed in U.S. Pat. Nos. 4,679,590 and 4,729,404. These patents disclose a rubber mat adapted for placement beneath a surgical site in sealed engagement with the floor. The top surface of the mat is configured as multiple inverted pyramidal elements configured to collect fluid and direct it to a drain hole on the bottom side of the mat. The bottom side of the mat is provided with flow channels that become sealed to the floor and converge to a common suction port adapted for connection to a source of suction that is commonly available at wall-mounted suction ports in surgical operating rooms. The suction delivers the recovered fluid to a canister for disposal.

Although the suction mat arrangement described above adequately removes fluid that falls on the mat, it cannot drain the rather significant amount of fluid that falls to the floor beyond the mat periphery. During arthroscopic surgery the sterile fluid delivered to the surgical site is often delivered at relatively high pressures, thereby making it difficult, if not impossible, for surgical personnel to direct the fluid so that, after flowing from the surgical site, it falls on the suction mat.

There are commercially available vacuum cleaners with movable suction heads adapted to draw liquid from floors toward a waste collection chamber. These devices, however, are not suitable for surgical environments for a number of reasons, not the least of which is the fact that the vacuum cleaner suction head must be manipulated by hand in order to be positioned at various spillage locations on the floor. Since the hands of operating room personnel are otherwise occupied during a surgical procedure, the use of a commercial vacuum cleaner would require additional personnel, thereby adding to the already high cost of surgery. Moreover, commercially available vacuum cleaners have built-in vacuum sources that are extremely noisy, thereby rendering communication between the surgeon and nurses difficult at best. It would be far more desirable to use a low level suction source (e.g., on the order of 300 millimeters of mercury below atmospheric pressure) such as is commonly available at a wall port in operating rooms; however, suction heads employed with commercial vacuum cleaners are incapable of operating at such low pressures.

Finally, the fluids that spill onto the floor during a surgical procedure are likely to be or become contaminated. Commercially available vacuum cleaner heads for liquids are not designed to be disposable after use and, accordingly, would become contaminated and present a health hazard.

OBJECTS AND SUMMARY OF THE INVENTION

Accordingly, it is a primary object of the present invention to provide a method and apparatus for efficiently removing fluids from surgical room floors without the disadvantages and hazards present in prior art methods and apparatus.

It is another object of the present invention to provide a suction head adapted for use with low level suction and capable of being easily translated along a surgical room floor without occupying the hands of surgical personnel.

Another object of the present invention is to provide a method for removing fluids from surgical room floors whereby a surgeon, nurse or other attending personnel can readily translate a suction head to different locations on the floor with his or her foot.

A further object of the present invention is to provide a suction head for use in conjunction with available suction sources in surgical operating rooms, the suction head being sufficiently inexpensive to be disposable after a single surgical procedure, relatively quiet in operation, and easily translated along the floor to locations of spilled fluid without detracting personnel from the surgical procedure.

In accordance with the present invention, a suction head for use in removing waste fluids from surgical operating room floors has a planar, low-friction bottom surface adapted to readily slide along the floor in response to translational forces applied by a foot of a surgeon, nurse or other surgery personnel. Flow channels recessed in the bottom surface extend from the periphery of the suction head to the mouth of a common suction port adapted for connection by flexible tubing to a waste fluid collection container or canister. The canister is also connected by means of a hose to a wall mounted suction port providing a negative low pressure on the order of 300 millimeters of mercury below atmospheric pressure. In the preferred embodiment, the suction head is a thin one-piece molded plate, preferably of resilient plastic material having a heat distortion temperature less than 270° F. so as to be sufficiently inexpensive to be discarded after each surgical procedure. The common suction port is defined as a tubular hose fitting extending upwardly from the top surface of the plate. Multiple support ribs extend along the top surface from the hose fitting to the suction head periphery in juxtaposition with respective flow channels to reinforce the flow channels against collapse and flow blockage.

BRIEF DESCRIPTION OF THE DRAWINGS

These and other objects, features and many of the attendant advantages of the present invention will be appreciated more readily as they become better understood from a reading of the following description considered in connection with the accompanying drawings wherein like parts in each of the several figures are identified by the same reference numerals, and wherein.

DESCRIPTION OF THE PREFERRED EMBODIMENT

Figure 1:
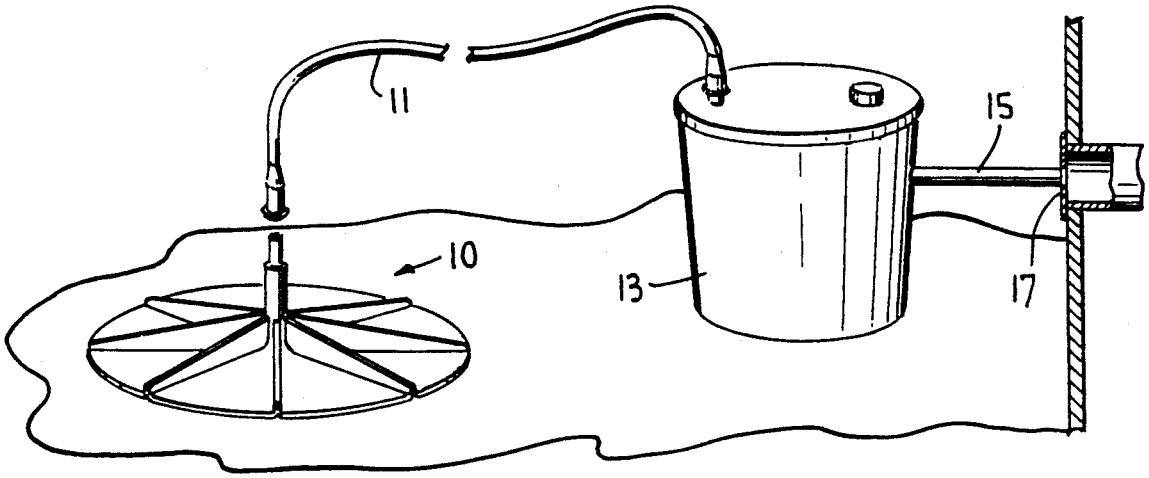
FIG. 1 is a view in perspective of a suction system employing a suction head in accordance with the present invention.

Referring specifically to FIG. 1 of the accompanying drawings, a suction system according to the present invention includes a suction head 10 connected by a flexible hose 11 to a waste liquid collection canister 13. Another hose 15 is connected between the canister 13 and a wall suction port 17 of the type commonly found in surgical operating rooms for supplying low level suction on the order of 300 millimeters of mercury below atmospheric pressure. Hoses 11 and 15 communicate with the interior of canister 13 through respective fittings at or near the canister top. Suction from the wall port is applied through the canister to suction head 10, and the aspirated fluid, upon reaching the canister, is sufficiently heavy in relation to the low suction to drop into the canister for collection and eventual disposal.

As described in detail below, suction head 10 is made to be disposable after a single surgical procedure; hose 11 may be similarly disposable. If canister 13 is provided with a permanent collection hose, disposable hose 11 may be inserted between that permanent hose and suction head 10. In any case, the hosing between canister 13 and suction head 10 is very flexible to permit free translation of suction head 10 along the floor of the operating room. Such translation is readily effected by translational forces applied to the suction head by the foot of a surgeon, nurse or other surgical personnel who might lightly kick, push or drag the suction head with his or her foot.

Figure 2:
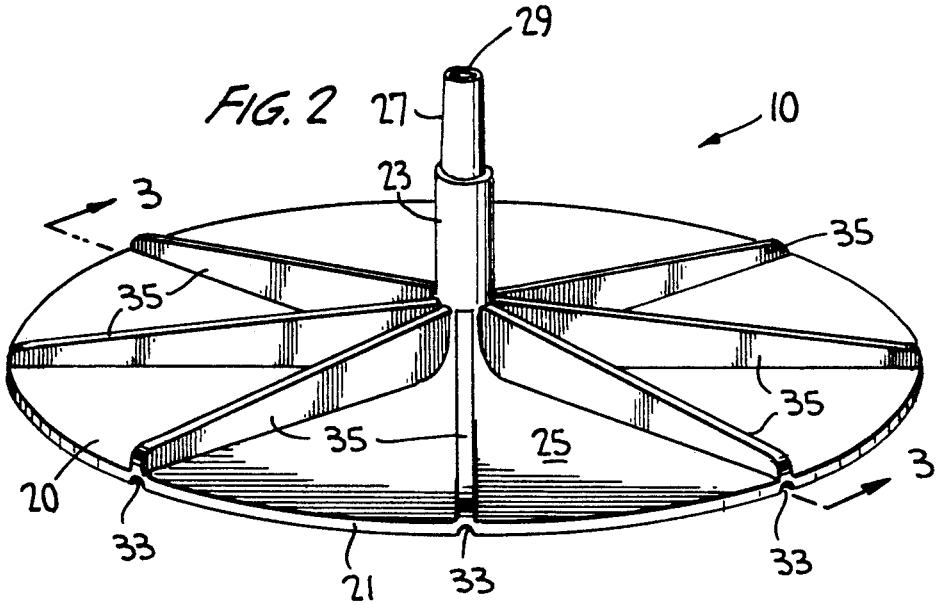
FIG. 2 is a top view in perspective of one embodiment of the suction head of the present invention.
Figure 3:
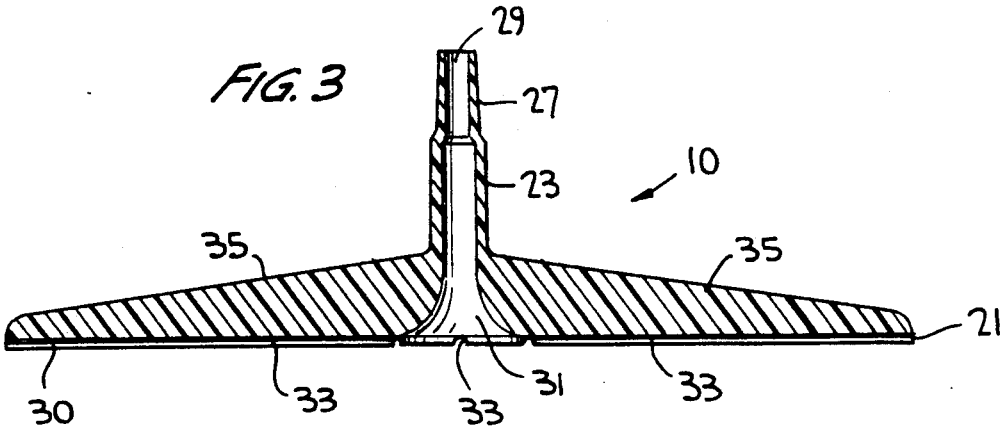
FIG. 3 is a view in section taken along line 3—3 of FIG. 2.
Figure 4:
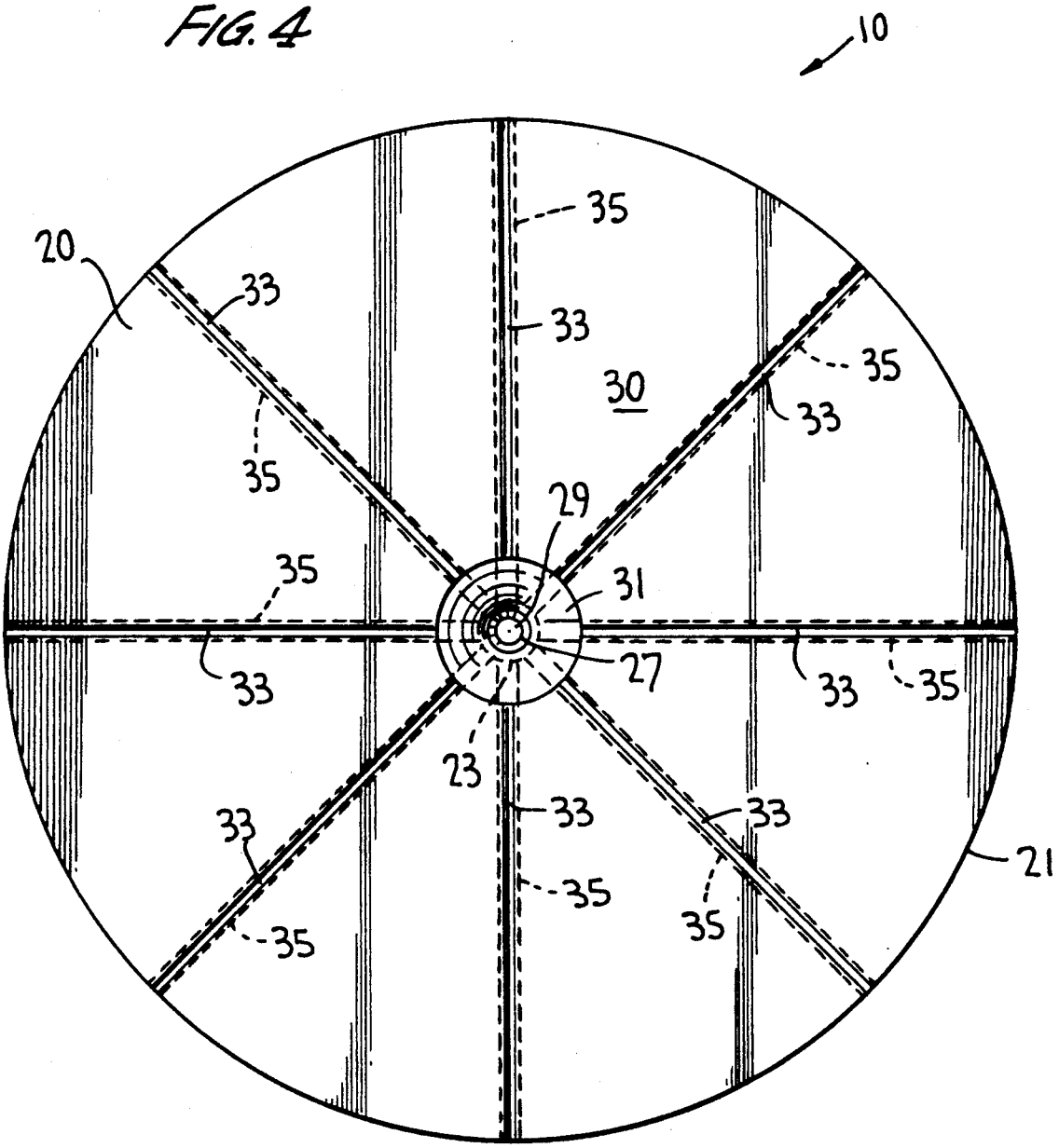
FIG. 4 is a bottom view in plan of the suction head of FIG. 2.

The preferred embodiment of suction head 10 of FIG. 1 is illustrated in greater detail in FIGS. 2, 3 and 4 to which specific reference is now made. The suction head is molded as a disposable single piece of lightweight resin material, preferably low density polypropylene, weighing on the order of four ounces with a heat distortion temperature below 270° F. to preclude attempts to sterilize the suction head after use. More specifically, because the suction head is likely to be exposed to contaminated or unsanitary fluids during use, it should not be re-used. If the suction head were able to withstand high sterilization temperatures (e.g., in an autoclaving procedure), users would not dispose of the suction head after use but would, instead, sterilize the head for re-use. When personnel are in the habit of re-using, rather than discarding, suction heads, it is possible that some suction heads may inadvertently not have been subjected to a sterilization procedure. The resulting contamination hazard is significant but may be avoided where personnel are in the habit of discarding inexpensive suction heads after each use with the knowledge that the suction heads cannot withstand sterilization temperatures.

Suction head 10 includes a circular plate 20 having a peripheral edge 21 and a hollow post 23 extending generally upwardly from its top surface 25. In the preferred embodiment, post 23 is generally cylindrical and centered on top surface 25 and is perpendicular thereto. A hose fitting 27 at the upper end of post 23 is formed as a smaller diameter extension of the post, the diameter being slightly greater than the inside diameter of hose 11 (FIG. 1) so that the fitting can be resiliently engaged within the hose. If desired, the engagement between hose 11 and fitting 27 can be secured by a hose clamp, or the like. An internal bore 29 extends longitudinally through the entire post 23 to a mouth 31 opening at the flat bottom surface 30 of the plate 20. Mouth 31 gradually widens from bore 29 as it approaches bottom surface 30 with a predetermined curvature, thereby providing a funnel-like construction.

A plurality of narrow flow channels 33 are defined in bottom surface 30 and extend from mouth 31 to the peripheral edge 21 of plate 20. For a circular plate 20 with its centered mouth 31 as configured in the preferred embodiment, the flow channels 33 are oriented radially, are eight in number and are spaced at equal angular intervals. It will be appreciated that the mouth 31 and/or port 23 need not be centered on plate 20 which, in turn, need not be circular. What is important, therefore, is that channels 33 communicate with bore 29, wherever it may be located, and with the plate periphery 21, whatever the shape of the plate. Flow channels 33 are both narrow and shallow so as to have a relatively small cross-sectional area. In the preferred embodiment the channels 33 each have semi-circular transverse cross-sections with a 0.03 inch radius for a plate 20 having an eight inch diameter, a mouth 31 approximately 1.0 inch in diameter, and a thickness of 0.10 inch. The total area of bottom surface 30 occupied by the eight flow channels 33 and mouth 31 in this preferred embodiment is, therefore, approximately 1.7 square inches. The area bounded by peripheral edge 21 is approximately 50.26 square inches. Accordingly, the ratio of these areas is approximately thirty-to-one. In order to provide a desired flow rate through suction head 10 in the range of 600–750 ml/min for a suction source pressure of 300 mm of mercury below ambient as described above, the area ratio should preferably not be less than twenty-to-one.

A plurality of support ribs 35 extend along top surface 25 from post 23 to periphery 21, and taper downwardly in height toward the periphery. Each rib is in juxtaposed relation with a corresponding flow channel 33 defined in bottom surface 30. The ribs are thicker than the flow channels and provide support for flexible plate 20 while preventing the channels 33 from collapsing due to the suction forces or from downward pressure if the suction head is accidently stepped on with the full weight of an individual. More specifically, the thicker ribs 35 distribute downwardly directed forces onto the non-recessed portion of bottom surface 30 rather than having such forces focused directly onto the channels 33. In addition, the semi-circular cross-section of the channels distributes downward forces along the channel side and away from the channel center, thereby acting in conjunction with the ribs to prevent channel collapse. This cross-section need not be semi-circular to accomplish this function; rather, it is only necessary that the channel width not be so large, relative to the channel depth, as to facilitate collapse. A ratio of channel width to channel depth on the order of three-to-one or less is satisfactory for this purpose.

In the preferred embodiment as described above, ribs 35 are 0.10 inch thick, have a maximum height adjacent post 23 of 0.73 inch, and a minimum height at periphery 21 of 0.22 inch. The downward taper angle of the ribs is eight degrees. The overall height of the suction head 10, from the top of fitting 27 to bottom surface 30, is 2.38 inches. Fitting 27 is 0.63 inch long with an upward taper angle of 1.5 and a minimum outside diameter of 0.359 inch. The inside diameter of fitting 27 is 0.18 inch. The lower portion of post 23 is 1.02 inch long and has an outside diameter that is 0.475 inch at its base with an upward taper of 1.5°. The inside diameter of post 23 is 0.28 inch. It is to be understood that all of these dimensions are by way of example only and are not limiting on the scope of the invention.

Although the suction head structure has been described and illustrated for a preferred embodiment, it is apparent that modifications may be made to the suction head within the scope of the present invention. For example, suction head 10 is preferably made from a molded synthetic resin to provide a disposable product; however, the suction head may be formed from any suitable material, such as metal, resin, impregnated fiberglass, or the like. The shape of the plate 20 has been illustrated as circular but any suitable regular or irregular shape may be employed, such as rectangular, ovoid, triangular, etc. A plate having any of these configurations is, in any case, provided with recessed channels 33 defined in the bottom surface 30 of the plate to communicate or extend from the periphery of the plate to the recessed mouth opening 31 of suction port 29. The recessed channels need not extend radially but, instead, may have any suitable configuration to provide the necessary passages for fluids being aspirated into suction port 29. Further, the channel cross-section need not be semi-circular but, instead, may be triangular, rectangular, irregular, etc.

Suction port 29, as illustrated in FIGS. 2–4, has a recessed mouth opening; however, it is apparent that the suction forces applied to flow channels 33 in the bottom surface 30 of plate 20 may be supplied through a number of various recessed manifold configurations. Such configurations include one or a plurality of apertures communicating between recessed channels 33 and suction port 29.

A primary feature of suction head 10 of the present invention is that it is readily manipulated by the foot of the surgeon, nurse or other personnel so as to be translated to locations on the floor at which liquid has been spilled. The translational forces are most easily applied to edge 21 at the distal end of a rib 35 and in a direction parallel to plate 20. As the ribs 35 are in radial alignment with flow channels 33, the ribs perform the additional function of structurally reinforcing the plate 20 at locations above the flow channels to prevent collapse of the channels, particularly at the periphery 21 of the plate, in the event that downward foot pressure is applied directly above a channel 33. Such collapse would create a suction seal under suction head 10 during operation, resulting in a decrease of manipulatability.

In the preferred embodiment of the present invention the bottom surface 30 of plate 20 is essentially a circular planar surface having a plurality of recessed channels 33 extending radially from the suction port 29 to the periphery of the plate. As the suction head rests on the floor, a major proportion of the area of bottom surface 30 contacts the floor surface. Therefore, the material employed for plate 20 must have a low coefficient of friction, or the bottom surface must be provided with a coating having a low coefficient of friction, in order to permit free movement of the suction head about the floor while suction is applied through suction port 29 and flow channels 33. Bottom surface 30 thus defines a support plane enabling the suction head to be easily moved about the floor surface from which fluid is to be aspirated. It is necessary only to provide the bottom surface in a configuration suitable to enable the suction head 30 to engage the floor surface with sufficient suction to remove fluids from the surface without preventing the suction head from being freely moved along the surface by minimal forces exerted in the translational direction.

The invention is also directed to a one-piece molded suction head 10 in combination with a hose 11 which may be utilized as a one-piece disposable unit.

From the foregoing description it will be appreciated that the present invention makes available a novel method and apparatus whereby a disposable suction head, in the form of a plate having a flat bottom surface with flow channels defined therein from the plate periphery to a common suction port, cooperates with a low level suction source commonly available in operating rooms, to remove spilled liquids at various locations that are accessible by foot manipulation of the suction head.

Having described a preferred embodiment of the present invention, it is believed that other modifications, variations and changes will be suggested to those skilled in the art in view of the teachings set forth herein. It is therefore to be understood that all such variations, modifications and changes are believed to fall within the scope of the present invention as defined by the appended claims.

What is claimed is:

1. Apparatus for aspirating fluid from a floor comprising a suction head movable along the floor, said suction head including a mouth adapted to communicate with a source of suction, a periphery, a top surface, a bottom surface adapted to contact the floor, channel means communicating with said mouth and said periphery for aspirating fluid on the floor through said mouth and preventing said suction head from sealing against the floor, said channel means including a plurality of flow channels extending through said suction head from said mouth to said periphery adjacent said bottom surface, said suction head further including a suction supply port disposed on said top surface and adapted to be connected to said source of suction, said suction supply port communicating directly with said mouth through said section head, and structural means for imparting support to said suction head and preventing collapse and blockage of said flow channels, said structural means comprising support ribs disposed on said top surface in juxtaposition with said flow channels and having a width greater than said flow channels to distribute forces applied vertically thereto to portions of said bottom surface disposed adjacent said flow channels.

2. Apparatus for aspirating fluid from a floor comprising a suction head movable along the floor having a mouth adapted to communicate with a source of suction, a periphery, channel means communicating with said mouth and said periphery for aspirating fluid on the floor through said mouth and preventing said suction head from sealing against the floor, and a bottom surface adapted to contact the floor, said channel means including a plurality of flow channels recessed in said bottom surface and extending from said mouth to said periphery, wherein the transverse cross-section of said flow channels has a ratio of channel width to channel depth sufficiently small to prevent the channel from collapsing against the floor under vertical forces applied to the suction head by the weight of the operator, wherein said cross-section is semi-circular.

3. Apparatus for aspirating fluid from a floor comprising a suction head movable along the floor having a mouth adapted to communicate with a source of suction, a periphery and channel means communicating with said mouth and said periphery for aspirating fluid on the floor through said mouth and preventing said suction head from sealing against the floor, wherein said suction head is a circular plate having a hollow tubular portion extending upwardly therefrom and communicating with said mouth to define a suction supply port, wherein said channel means comprises flow channels extending radially from said mouth and opening to said periphery, and wherein said plate includes structural means comprising a plurality of raised ribs each extending radially along said plate from said suction supply port to said periphery, each rib being in juxtaposed alignment with a corresponding flow channel, said suction head being a single piece of molded plastic having a heat distortion temperature below 270° F. and a sufficiently low coefficient of friction to permit said suction head to readily slide along said floor.

4. The apparatus according to claim 3 further comprising:

a waste collection chamber having an inlet port and an outlet port;

means for connecting said source of suction to said outlet port; and flexible hose means connected between said inlet port and the suction supply port of said suction head;

whereby suction from said source is applied to the suction supply port of said suction head through said chamber and said hose means to draw waste fluid from said floor and through said suction head and said hose means into said chamber wherein the waste fluid falls and is collected.

5. Apparatus for aspirating liquid from a surgical operating room floor comprising:

suction head means for sliding along said floor in response to being lightly kicked, pushed or dragged along the floor by a foot of a surgeon or other operating room personnel, said suction head means being configured as a plate having a peripheral edge, a flat bottom surface for resting upon and sliding along said floor, a mouth adapted to communicate between a source of suction and said bottom surface, and a plurality of narrow flow channels defined as recesses in said bottom surface communicating between said mouth and said peripheral edge for aspirating safe liquid through said mouth and for preventing said bottom surface from sealing against said floor;

wherein said plate includes a top surface and a suction supply port disposed on said top surface adapted to be connected to said source of suction, said suction supply port communicating directly with said mouth through said plate, and wherein said bottom surface has a sufficiently low coefficient of friction to permit said plate to freely slide along said floor in response to application of translational forces thereto; and further comprising structural means for imparting support to said plate and preventing collapse and blockage of said flow channels, said structural means comprising a plurality of support ribs disposed along said top surface in juxtaposition with respective flow channels and having a width greater than said flow channels to distribute vertically directed forces applied vertically to said ribs to portions of said bottom surface disposed adjacent said flow channels.

6. The apparatus according to claim 5 wherein the ratio of the total area bounded by said periphery to the area of said bottom surface occupied by said flow channels and said mouth is on the order of twenty-to-one or more.

7. The apparatus according to claim 5 wherein said periphery is circular, wherein said mouth is centered within the circular periphery, and wherein said flow channels and said support ribs extend radially from said mouth to said periphery.

8. The apparatus according to claim 5 wherein the transverse cross-section of said flow channels has a ratio of channel width to channel depth sufficiently small to prevent the channels from collapsing against said floor under vertical forces applied to the plate by the weight of operating room personnel.

9. The apparatus according to claim 8 wherein said ratio is no greater than approximately three-to-one.

10. The apparatus according to claim 5 wherein said plate is a single piece of molded plastic material having a heat distortion temperature below 270° F.

11. Apparatus for aspirating liquid from a surgical operating room floor comprising:

suction head means for sliding along said floor in response to being lightly kicked, pushed or dragged along the floor by a foot of a surgeon or other operating room personnel, said suction head means being configured as a plate having a peripheral edge, a flat bottom surface for resting upon and sliding along said floor, a mouth adapted to communicate between a source of suction and said bottom surface, and a plurality of narrow flow channels defined as recesses in said bottom surface communicating between said mouth and said peripheral edge for aspirating said liquid through said mouth and for preventing said bottom surface from sealing against said floor;

wherein the transverse cross-section of said flow channels has a ratio of channel width to channel depth sufficiently small to prevent the channels from collapsing against said floor under vertical forces applied to the plate by the weight of operating room personnel; and wherein said cross-section is semi-circular.

12. The apparatus according to claim 11 wherein said suction head is a single piece of molded plastic material having a heat distortion temperature below 270° F.

13. The apparatus according to claim 11 wherein said periphery is circular, wherein said mouth is centered within the circular periphery, and wherein said flow channel extend radially from said mouth to said periphery.

* * * * *